US005448785A

United States Patent [19]

Lin

[11] Patent Number: 5,448,785

[45] Date of Patent: Sep. 12, 1995

[54] PORTABLE TOILET WITH A SURROUNDING SHIELD

[76] Inventor: Chen-Yuan Lin, No. 57, Lane 67, Sec. 2, Chung Shan Road, Changhua City, Taiwan

[21] Appl. No.: 301,640

[22] Filed: Sep. 7, 1994

[51] Int. Cl.[6] ..... A47K 11/06

[52] U.S. Cl. ..... 4/484

[58] Field of Search ..... 4/449, 483, 484

[56] References Cited

U.S. PATENT DOCUMENTS

| | | | |
|---|---|---|---|
| 2,849,726 | 9/1958 | Vay | 4/484 X |
| 4,380,836 | 4/1983 | Braxton | 4/449 X |
| 4,995,122 | 2/1991 | Mohnhaupt | 4/483 |
| 5,048,130 | 9/1991 | Brotman et al. | 4/484 X |
| 5,187,819 | 2/1993 | Grimes | 4/484 X |

*Primary Examiner*—Charles E. Phillips
*Attorney, Agent, or Firm*—Browdy and Neimark

[57] ABSTRACT

A portable toilet comprising a toilet bowl and a paper-made surrounding shield. The surrounding shield is made from a rectangular paper board which has three folding lines dividing the paper board into four equal quarters serving as two lateral walls, a door board and a rear wall of the surrounding shield. An upper half of each folding line is cut open to form a fissure. The paper board further has a transverse middle folding line at which an upper half of each quarter can be folded outward. A male and female fastening belt set is disposed at each fissure to support the four walls upright. A male and female fastening belt set is disposed at the door board of the surrounding shield for closing the door board. The toilet bowl is made by means of cutting a hard thick paper board into a square body with four close faces. Reinforcing ribs are disposed on outer faces of the four walls for strengthening the toilet bowl. Two hook members are disposed on inner faces of the toilet bowl for hooking a plastic bag to contain excretion. A seat pad board integrally extends from upper edge of each of two opposite walls and is cut with arch notch to suit the hip portion of a user. The seat pad board is foldable toward the other to be supported on the upper edges of the other two opposite walls for the user to sit thereon.

1 Claim, 5 Drawing Sheets

PORTABLE TOILET WITH A SURROUNDING SHIELD

BACKGROUND OF THE INVENTION

The present invention relates to a portable toilet with a surrounding shield, which includes a square hard paper-made toilet bowl and a rectangular hard paper-made surrounding shield. The portable toilet bowl can be easily carried for outdoor use.

When going outdoors, generally there is no available toilet facilities for solving the problem of excretion. Therefore, it is necessary to develop a light, foldable and portable paper-made toilet for outdoor use so as to eliminate the possible embarrassment caused by the excretion problem.

SUMMARY OF THE INVENTION

It is therefore a primary object of the present invention to provide a portable paper-made toilet which has light weight and can easily folded and unfolded for outdoor use to solve the excretion problem.

It is a further object of the present invention to provide the above portable toilet which can be previously prepared before going outdoors.

According to the above objects, the portable toilet of present invention comprises a toilet bowl and a surrounding shield. The surrounding shield is made from a rectangular paper board which has three folding lines dividing the paper board into four equal quarters serving as the walls of the surrounding shield. An upper half of each folding line is cut open to form a fissure. The paper board further has a transverse middle folding line at which an upper half of each quarter can be folded outward, Each of two quarters which form lateral walls of the surrounding shield is divided into two halves by a longitudinal folding line. The other two quarters which form a front wall and a rear wall of the surrounding shield are respectively provided with two handles at the transverse folding line. Two female fastening belts are disposed on upper portion of inner face of the rear wall of the surrounding shield. A long male and a short female fastening belts are disposed on a front door board of the surrounding shield. A male and female fastening belt set is disposed at each fissure to support the four walls upright. A male and female fastening belt set is disposed at the door board for closing the door board.

The paper-made toilet bowl is made by means of cutting a hard thick paper board into a square body with four close faces. Reinforcing ribs are disposed on outer faces of the four walls for strengthening the toilet bowl. Male fastening belts are disposed on surfaces of two reinforcing ribs and two hook bodies are disposed on inner faces thereof for hooking a plastic bag to contain excretion. A seat pad board integrally extends from upper edge of each of two opposite walls. The seat pad board is foldable inward toward the other to be supported on the upper edges of the other two opposite walls for the user to sit thereon. Inner side of each seat pad board is cut with an arch notch to suit a hip portion of the user.

After used, the surrounding shield is folded outward at the transverse folding line. Then the lateral walls are folded toward each other at the longitudinal folding lines. The toilet bowl can be folded and flattened to overlap on the folded surrounding Shield. The male fastening belts of the reinforcing ribs are attached to the female fastening belts of the surrounding shield. The long male fastening belt is used to surround the folded toilet bowl and attach to the short female fastening belt so as to associate the toilet bowl with the surrounding shield.

The present invention can be best understood through the following description and accompanying drawings, wherein:

DETAILED DESCRIPTION OF THE PREFERRED EMBODIMENT

Figure 1:
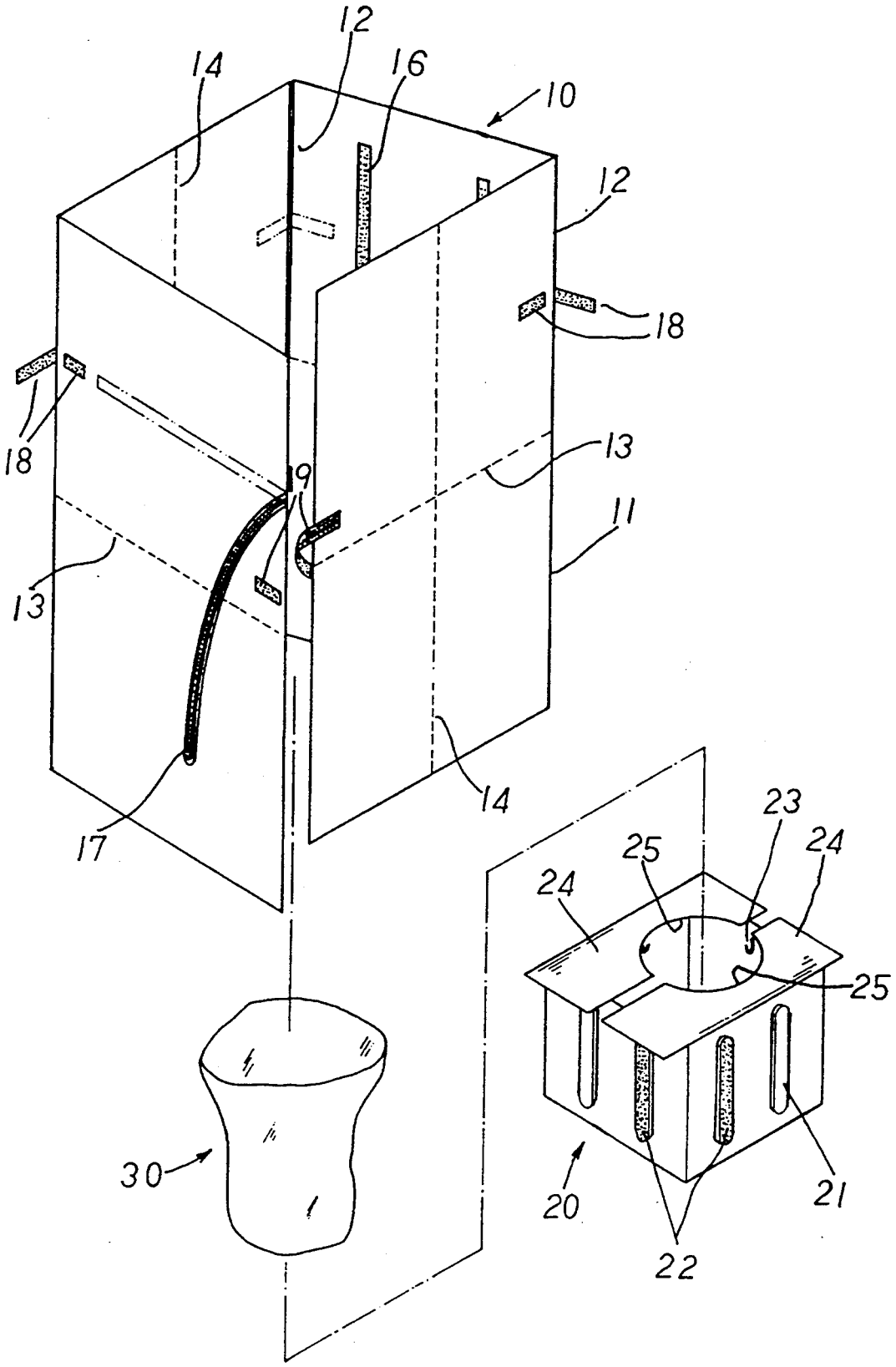
FIG. 1 is a perspective exploded view of the present invention.
Figure 2:
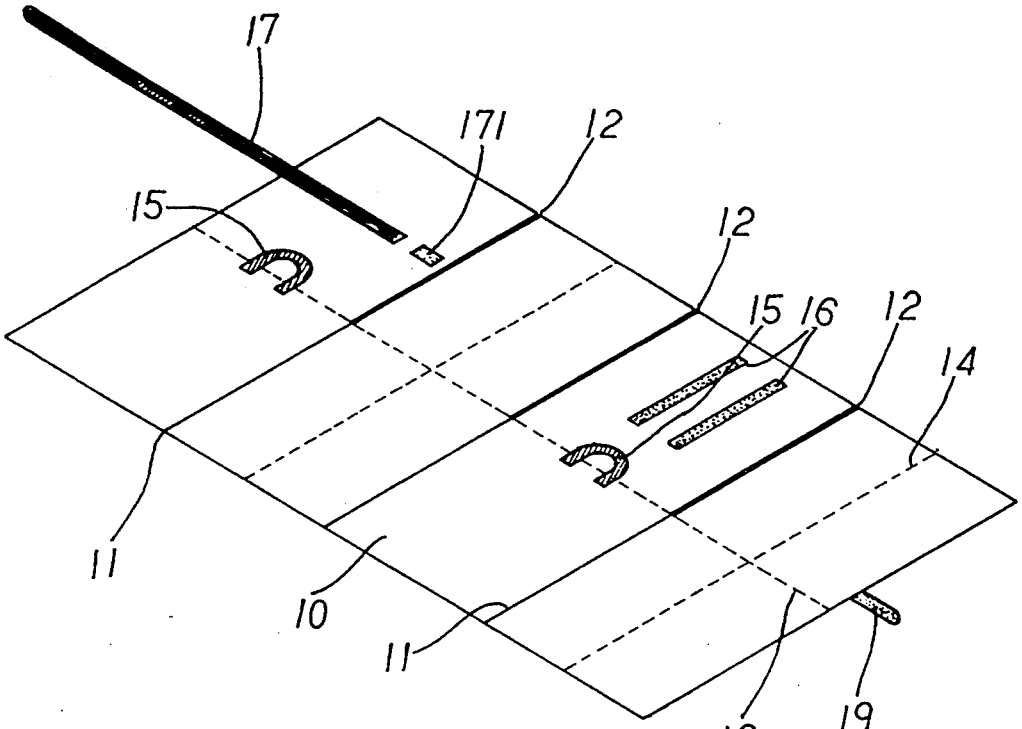
FIG. 2 is a perspective stretched view of the inner face of the surrounding Shield of the present invention.
Figure 3:
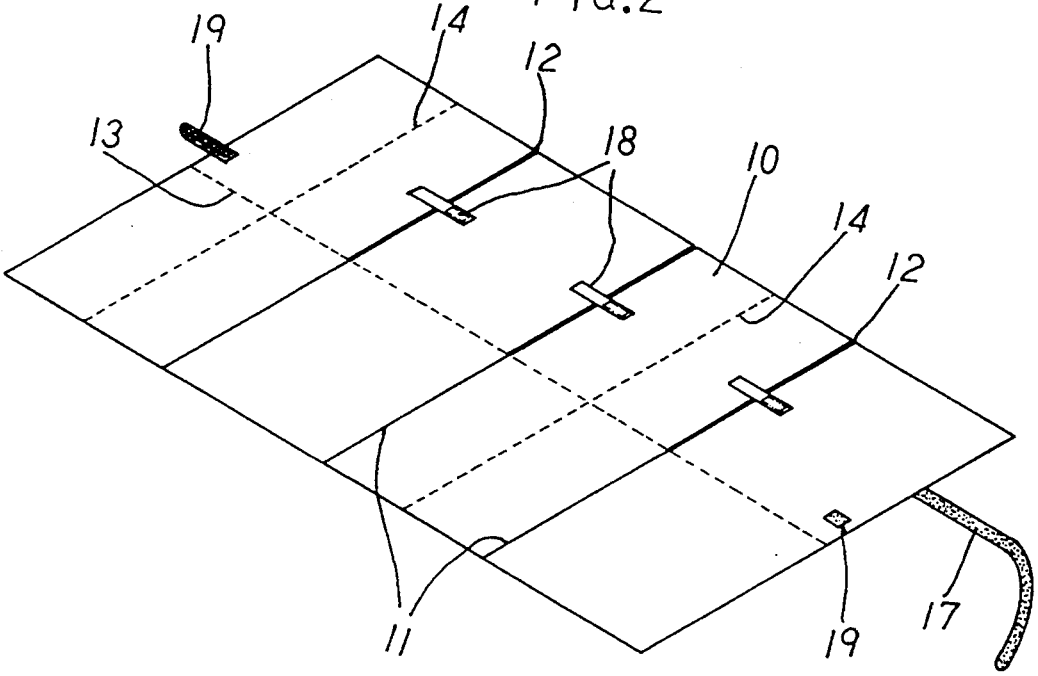
FIG. 3 is a perspective stretched view of the outer face of the surrounding shield of the present invention.

Please refer to FIG. 1. The present invention includes a paper-made toilet bowl 20 and a paper-made surrounding shield 10. Referring to FIGS. 2 and 3, the surrounding shield 10 is made from a rectangular paper board which has three folding lines 11 dividing the paper board into four equal quarters serving as the walls of the surrounding shield 10. An upper half of each folding line 11 is cut open to form a fissure 12.

The paper board further has a transverse middle folding line 13 at which an upper half of each quarter can be folded outward. Each of two quarters which form lateral walls of the surrounding shield is divided into two halves by a longitudinal folding line 14. The other two quarters which form a front wall and a rear wall of the surrounding shield are respectively provided with two handles 15 at the transverse folding line 13. In addition, two female fastening belts 16 are disposed on upper portion of inner face of the rear wall of the surrounding shield for attaching to a male fastening belt of the toilet bowl. A long male and a short female fastening belts 17 and 171 are disposed on the front wall (door board) of the surrounding shield, whereby the long male fastening belt 17 can be used to surround the surrounding shield to engage with the short female fastening belt 171. A male and female fastening belt set 18 is disposed at each fissure 12 to support the four walls upright. A male and female fastening belt set 19 is disposed at the door board for closing the door board.

Figure 4:
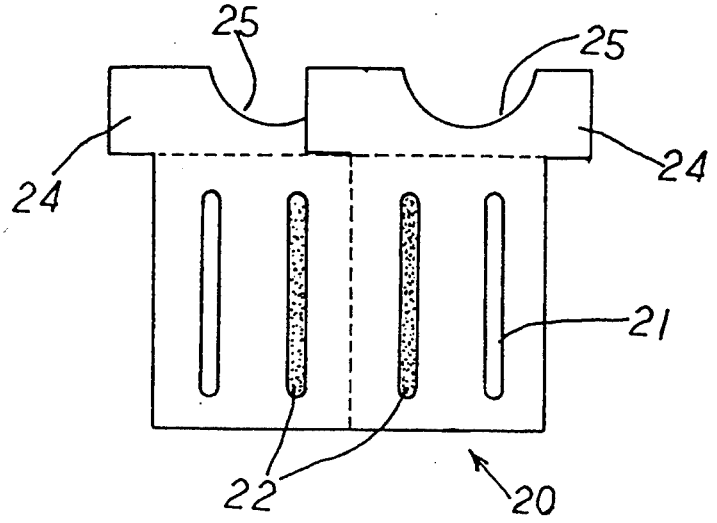
FIG. 4 is a plan view of the flattened toilet bowl of the present invention.

Referring to FIG. 4, the paper-made toilet bowl 20 is made by means of cutting a hard thick paper board into a square body with four walls. Reinforcing ribs 21 are disposed on outer faces of the four walls for strengthening the toilet bowl so as to bear the weight of a user. Male fastening belts 22 are disposed on surfaces of two reinforcing ribs and two hook bodies 23 are disposed on inner faces thereof for hooking a plastic bag 30 so as to contain excretion. A seat pad board 24 integrally extends from upper edge of each of two opposite walls. The seat pad board 24 can be folded inward toward the other to be supported on the upper edges of the other two opposite walls for the user to sit thereon. An inner edge of each seat pad board 24 is cut with an arcuate notch 25 to suit the curve of the hip Of the user. After the toilet bowl is used, the plastic bag can be taken out and the toilet bowl can be folded Up and flattened as shown in FIG. 4.

Figure 5:
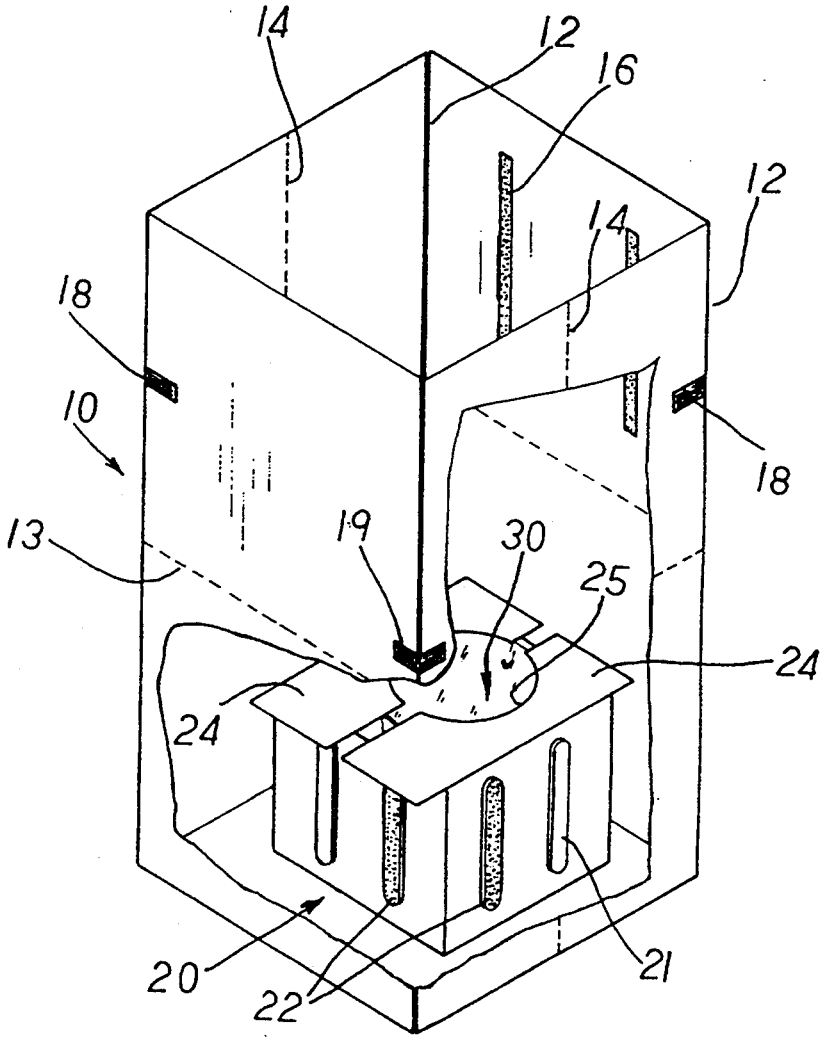
FIG. 5 is a perspective assembled view of the present invention.
Figure 6:
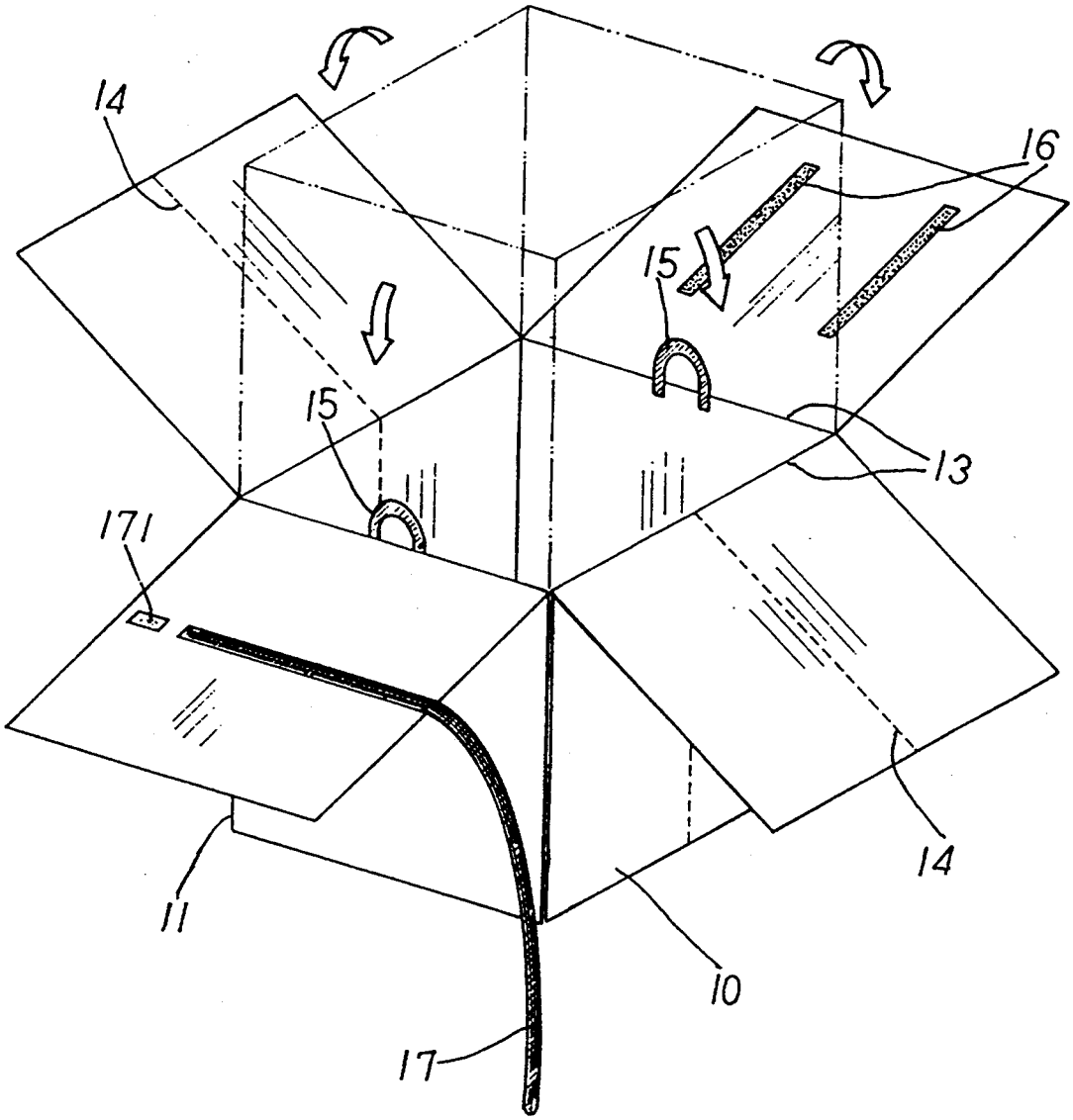
FIG. 6 is a perspective view showing the folding operation of the surrounding shield.
Figure 7:
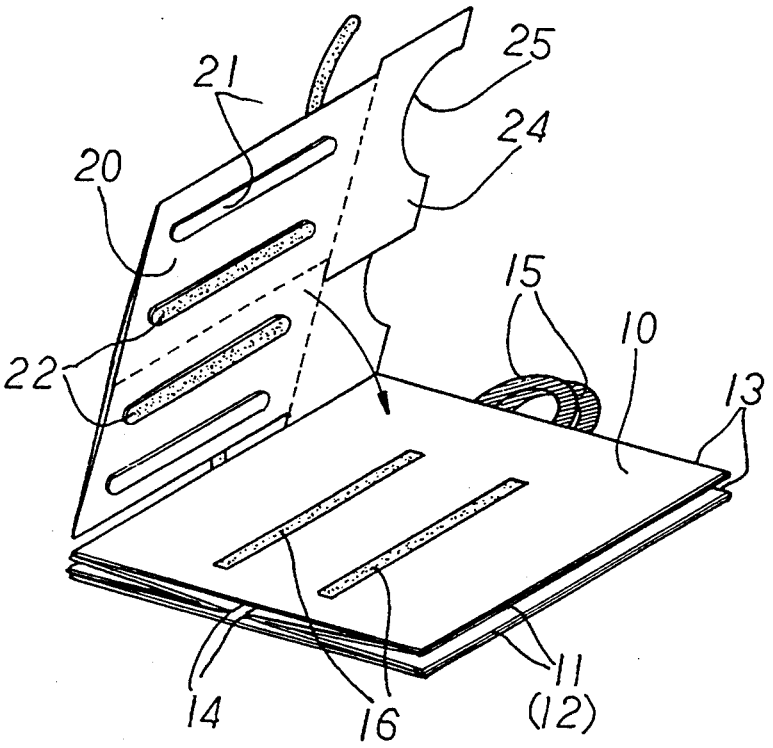
FIG. 7 is a perspective view showing that the flattened toilet bowl is overlapped on the flattened surrounding shield.
Figure 8:
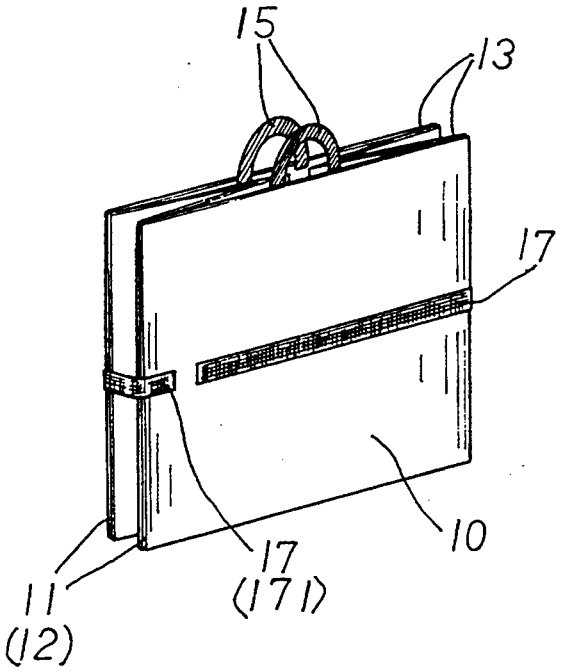
FIG. 8 is a perspective view showing the assembly of the folded toilet bowl and surrounding shield.

FIG. 5 shows an assembled state of the present invention for use outdoors. As shown in FIG. 6, after used, the male and female fastening belt set is first torn apart and then the surrounding shield 10 is folded outward at the transverse folding line 13. Then the lateral walls are folded toward each other at the longitudinal folding lines 14. Further, the surrounding shield is folded at folding lines 11 into a state as shown in FIG. 7. The toilet bowl 20 can be folded and flattened to overlap on the folded surrounding shield 10. The male fastening belts 22 of the reinforcing ribs 21 are attached to the female fastening belts 16 of the surrounding shield. As shown in FIG. 8, the long male fastening belt 17 is used to surround the folded toilet bowl and attach to the short female fastening belt 171 so as to associate the toilet bowl with the surrounding shield. The handles 15 facilitate the carriage of the toilet bowl and the surrounding shield.

The above embodiment is only an example of the present invention and the scope of the present invention should not be limited to the example. Any modification or variation derived from the example should fall within the scope of the present invention.

What is claimed is:

1. A portable toilet comprising a toilet bowl and a paper-made surrounding shield, wherein:

said surrounding shield comprises a rectangular paper board which has three folding lines dividing the paper board into four equal quarters serving as the walls of said surrounding shield, an upper half of each folding line being cut open to form a fissure, said paper board further having a transverse middle folding line at which an upper half of each quarter can be folded outward, each of two quarters which form lateral walls of the surrounding shield being divided into two halves by a longitudinal folding line, the other two quarters which form a front wall, serving as a door board, and a rear wall of the surrounding shield being respectively provided with two handles at the transverse folding line, two female fastening belts being disposed on the inner face of the upper portion of said rear wall of the surrounding shield, a long male and a short female fastening belt being disposed on said front wall of the surrounding shield, a male and female fastening belt set being disposed at each fissure to support the four walls upright, a male and female fastening belt set being disposed at said door board for closing thereof;

said toilet bowl is made by means of cutting a hard thick paper board into a square body with four walls, reinforcing ribs being disposed on outer surfaces of the four walls for strengthening the toilet bowl, male fastening belts being disposed on surfaces of two reinforcing ribs and two hook bodies being disposed on inner surfaces of at least two walls for hooking a plastic bag, a seat pad board integrally extending from an upper edge of each of two opposite walls, each said seat pad board being foldable inwardly toward the other seat pad board to be supported on the upper edges of the remaining two opposite walls for the user to sit thereon, an inner edge of each seat pad board being cut with an arcuate notch, whereby after the toilet bowl is used, the plastic bag can be taken out and the toilet bowl can be folded into a flattened state and placed on said surrounding shield also in a folded state, said long male fastening belt being used to surround the folded toilet bowl and attach to said short female fastening belt so as to secure said toilet bowl to said surrounding shield, said handles serving to facilitate the carriage of the toilet bowl and the surrounding shield.

* * * * *